US011241855B2

(12) United States Patent
Räsänen et al.

(10) Patent No.: US 11,241,855 B2
(45) Date of Patent: Feb. 8, 2022

(54) METHOD AND APPARATUS FOR DEEP-DRAWING A TRAY FROM SHEET MATERIAL

(71) Applicant: Stora Enso OYJ, Helsinki (FI)

(72) Inventors: Jari Räsänen, Imatra (FI); Kimmo Nevalainen, Kotka (FI); Henry Lindell, Imatra (FI); Panu Tanninen, Rauha (FI); Sami Matthews, Lappeenranta (FI); Mari Hiltunen, Imatra (FI); Outi Kylliainen, Imatra (FI)

(73) Assignee: Stora Enso OYJ, Helsinki (FI)

( * ) Notice: Subject to any disclaimer, the term of this patent is extended or adjusted under 35 U.S.C. 154(b) by 417 days.

(21) Appl. No.: 15/518,178

(22) PCT Filed: Oct. 8, 2015

(86) PCT No.: PCT/IB2015/057700

§ 371 (c)(1),
(2) Date: Apr. 10, 2017

(87) PCT Pub. No.: WO2016/059516

PCT Pub. Date: Apr. 21, 2016

(65) Prior Publication Data

US 2017/0305097 A1 Oct. 26, 2017

(30) Foreign Application Priority Data

Oct. 17, 2014 (SE) ..... 1451243-8

(51) Int. Cl.
*B31F 1/00* (2006.01)
*B31B 50/44* (2017.01)
(Continued)

(52) U.S. Cl.
CPC ..... *B31B 50/44* (2017.08); *B31B 70/00* (2017.08); *B31F 1/0077* (2013.01); *B65D 1/26* (2013.01);
(Continued)

(58) Field of Classification Search
CPC ... B31B 50/142; B31B 50/252; B31B 50/592; B65D 21/02
(Continued)

(56) References Cited

U.S. PATENT DOCUMENTS 2,296,744 A * 9/1942 Simmons ..... D21J 1/00 425/343
2,305,998 A * 12/1942 Simmons ..... D21J 1/00 425/343
(Continued)

FOREIGN PATENT DOCUMENTS

EP 0082209 A2 6/1983
EP 0433857 A2 6/1991
(Continued)

OTHER PUBLICATIONS

International Search Report for PCT/IB2015/057700, dated Feb. 15, 2016.
(Continued)

*Primary Examiner* — Eyamindae C Jallow
(74) *Attorney, Agent, or Firm* — Greer, Burns & Crain Ltd.

(57) ABSTRACT

The invention relates to a method and an apparatus for deep-drawing a tray (1) from a blank of sheet material (2). The blank is provided with score lines, which determine the location of wrinkles formed in the process. The apparatus comprises a female moulding tool (3), which comprises a cavity (7) for forming the tray bottom outwardly, a male moulding tool (4), which comprises a plunger (11) for forming the tray bottom inwardly, the plunger being movable with respect to the cavity for forming the tray, and clamps (6, 15) with an interface for holding the sheet material and forming a tray rim flange. According to the invention by laterally distancing at least one of the moulding tools (3, 4) from the sheet material leeway is pro-vided for free forming so that wrinkling of the tray side walls is achieved in a controlled manner. Spacer plates (13) may be positioned behind the plunger (11), to adjust its position in relation to the cavity (7) of the female moulding tool (3). The cavity may have a separate bottom plate (8) and spacer
(Continued)

plates (9) therebelow, or screw means may be provided for adjusting the distance of the bottom of the cavity from the clamp interface and thereby varying the depth of the tray.

9 Claims, 3 Drawing Sheets

(51) Int. Cl.

| | |
|---|---|
| ***B65D 1/26*** | (2006.01) |
| ***B65D 1/34*** | (2006.01) |
| ***B31B 70/00*** | (2017.01) |
| *B31B 160/10* | (2017.01) |
| *B31B 50/59* | (2017.01) |
| *B31B 100/00* | (2017.01) |
| *B31B 50/25* | (2017.01) |

(52) U.S. Cl.
CPC ..... *B65D 1/34* (2013.01); *B31B 50/25* (2017.08); *B31B 50/592* (2018.05); *B31B 2100/0024* (2017.08); *B31B 2160/10* (2017.08)

(58) Field of Classification Search
USPC ..... 493/169
See application file for complete search history.

(56) References Cited

U.S. PATENT DOCUMENTS 3,054,144 A * 9/1962 Goodwin ..... B31B 70/00 425/356
3,695,084 A 10/1972 Siemonsen et al.
4,026,458 A 5/1977 Morris et al.
4,071,598 A * 1/1978 Meadors ..... B29C 51/006 264/163
4,108,941 A 8/1978 Kermoian
4,149,841 A * 4/1979 Patterson ..... B29C 51/087 425/387.1
4,246,223 A * 1/1981 Patterson ..... B29C 51/087 264/292
4,576,565 A * 3/1986 Chlystun ..... B29C 57/00 425/383
4,755,128 A * 7/1988 Alexander ..... B29C 37/0007 249/66.1
4,778,439 A * 10/1988 Alexander ..... B29C 51/082 493/169
6,527,687 B1 * 3/2003 Fortney ..... B26F 1/40 493/56
9,649,807 B2 5/2017 Bartoli et al.
2002/0086784 A1 7/2002 Dai
2005/0109653 A1 5/2005 Wnek et al.
2013/0043151 A1 2/2013 Bartoli et al.
2013/0064998 A1 * 3/2013 Wnek ..... B21D 22/26 428/34.1

FOREIGN PATENT DOCUMENTS

EP 1985437 A2 10/2008
GB 1553975 A 10/1979
JP S54127965 A 10/1979
JP 2011530431 A 12/2011
JP 3185366 U 8/2013
WO 2010/018306 A1 2/2010
WO WO-2010018306 A1 * 2/2010 ..... B29C 45/14336
WO 2011/098886 A2 8/2011
WO 2015/063643 A1 5/2015

OTHER PUBLICATIONS

Written Opinion of the International Searching Authority for PCT/IB2015/057700, dated Feb. 15, 2016.

* cited by examiner

METHOD AND APPARATUS FOR DEEP-DRAWING A TRAY FROM SHEET MATERIAL

This application is a U.S. National Stage under 35 U.S.C. § 371 of International Application No. PCT/IB2015/057700, filed Oct. 8, 2015, which claims priority to Swedish Patent Application No. 1451243-8, filed Oct. 17, 2014.

FIELD OF THE INVENTION

This invention relates to a method and an apparatus for deep-drawing a tray from sheet material. Such trays are useful as disposable tableware or as a part of a heat-sealed product package especially for food.

DESCRIPTION OF RELATED ART

Packaging trays are extensively used for packages of fresh or readymade foods. Trays are made of fibrous materials such as polymer-coated paperboard or cardboard, or metal such as aluminum, and closed with a heat-sealed polymer film or a lid of polymer-coated board. Polymer coating is provided for turning the material liquid- and gas-tight as well as for heat-sealability. The shelf life of fresh foods is only very short, and a leak proof and air-tight sealing is often required. Some foodstuffs also require a rather stiff packaging tray.

For manufacturing a tray by deep-drawing, a blank of sheet material is positioned between a male and a female moulding tool, and the moulding tools are then moved in relation to each other, to form the tray, which has a bottom and upwardly expanding side walls surrounding the bottom.

Major problems in turning blanks into trays are tearing of the sheet material during deep-drawing as well as management of wrinkling of the board as the tray is being formed. Wrinkling is a handicap of materials, particularly paper, board and metals, which have limited plasticity and adaptability to shaping in the process. Wrinkles occur especially in the corners of trays of a generally rectangular shape, but also along the side walls and the peripheral flange of circular and oval trays.

There is prior art aiming at avoiding the wrinkles altogether. Another approach is to allow wrinkling, but control it by means of premade score lines, which determine the location of the bends forced upon the material as it is drawn to the shape of a tray. However, in the present deep-drawing processes wrinkling of the material tends to be irregular, producing trays which have an aesthetically unsatisfactory appearance.

An example of prior art trays and sealed covering lids is found from GB 2 123 786 A. Pressing of polyester coated board material to a tray-formed container has produced corrugations (wrinkles) extending from the corner sidewalls to the rim flange of the tray. A film cover been heat-sealed to the rim flange to provide a leakproof package.

U.S. Pat. No. 4,026,458 shows a rectangular container deep-drawn from a polymer-coated paperboard blank, wrinkled to have pleated folds in the corner sidewalls and rim flange of the container. The moulding tools for deep-drawing include an upper mandrel and a lower mold, which are movable in relation to each other for drawing the blank to the mold, to adopt the form of the container.

EP 1 115 572 B1 is dealing with the potential leaking problem of sealed packages comprising a paper container with bending lines (wrinkles) in the corners and a lid heat-sealed to the annular edge (flange) of the container. The reference suggests use of a coating layer of a minimum thickness able to smooth any unevennesses in the corners and thereby avoid leaks through the wrinkles.

FI application 20125304 teaches solving the wrinkle problem by multiplication of side wall step forming at a single or a plurality of working steps, thus moulding the side walls of the tray to have a concentrically stepped profile around the tray bottom. The aim is to avoid wrinkling of the material altogether.

U.S. Pat. No. 4,246,223 teaches control of wrinkling by providing the board material with premade score lines, which retract and close up as a blank of the material is turned to a tray. According to this reference score lines may be done by cutting or laser means.

A further problem of prior art moulding tools is that as the size of the tray is varied, each size requires tools of its own, without adaptability to e.g. different depths of the tray. The same applies to the thickness of the sheet material being used; changing the material thickness forces a change of the working tools also.

In the prior art WO 2010/018306 describes a moulding tool system, in which the depth of a board based container may be changed by detachably attaching to the mould cavity of the female moulding tool an insert, which forms a new bottom for the cavity and thus reduces the cavity depth and the depth of the container being formed accordingly.

OBJECTS AND SUMMARY OF THE INVENTION

The present invention is aimed at improving management of wrinkling of the sheet material by way of a novel method and apparatus for forming a tray by deep-drawing. The method according to the invention comprises (i) providing the sheet material with score lines transversally to the circumference of the tray being formed, (ii) bringing the scored sheet material between a female moulding tool, which comprises a cavity for forming the tray bottom outwardly, and a male moulding tool, which comprises a plunger for forming the tray bottom inwardly, (iii) clamping the sheet material along said circumference of the tray by means of the female and male moulding tools, to hold the material during the deep-drawing step, and (iv) moving the plunger with respect to the cavity for forming the tray, while between the cavity bottom and the clamp interface at least one of the male and female moulding tools is laterally distanced from the sheet material, to let the score lines determine constriction of the side wall of the tray in an open space provided by the at least one laterally distanced moulding tool.

The apparatus according to the invention, for deep-drawing a tray from sheet material, comprises (i) means for providing the sheet material with score lines, (ii) a female moulding tool, which comprises a cavity for forming the tray bottom outwardly, (iii) a male moulding tool, which comprises a plunger for forming the tray bottom inwardly, the plunger being movable with respect to the cavity for forming the tray, and (iv) clamps with an interface for holding the sheet material and forming a tray rim flange, wherein within a vertical span between the cavity bottom and the clamp interface the male and female moulding tools are laterally distanced from each other to provide an open space for forming of the side wall of the tray.

According to the invention control of wrinkling in the tray side walls is improved by distancing between the cavity bottom and the clamp interface at least one of the male and female moulding tools laterally from the sheet material, so as to allow free forming of the side wall of the tray. For instance, the male moulding tool may comprise spacer plates positioned behind the plunger and laterally distanced from the sheet material and thus leave free open space inside of the tray side wall being formed. Preferably both the male and the female moulding tools are laterally distanced from the sheet material so as to leave free open space to both sides of the tray side wall being formed.

The advantage of the above embodiments is that the surfaces of the moulding tools are not snugly fitted to the thin sheet material as usual, hampering constriction of the sheet material and emergence of the wrinkling, and even forcibly stretching the material with a risk of tearing, but the open space allows the sheet material to adapt to moulding without being forced. As regards the wrinkles the open space allows them to form freely, without compression producing an irregular and unaesthetic appearance as is the case with tightly fitted moulding tools according to the prior art.

Use of spacer plates to distance the male moulding tool from the sheet material also allows adjustment of the position of the plunger in respect of the female moulding tool. By making even the cavity of the female moulding tool adjustable, the depth of the tray that is being formed may be varied.

According to an embodiment of the invention the female moulding tool has a cavity bottom plate, which can be raised by means of spacer plates installed below said bottom plate. The depth of the tray may thus be increased by adding spacer plates to the male moulding tool and by removing spacer plates from the female moulding tool, i.e. from below the bottom plate, accordingly. Naturally, the opposite shall be done when the depth of the tray is decreased.

According to another embodiment of the invention in the female moulding tool at least one screw is provided to adjust the distance to the clamp interface. Such a screw thus replaces the above-mentioned spacer plates below the bottom plate. The screw may connect the cavity bottom to a clamp on the underside of the tray rim flange. In this way the apparatus may be easily and precisely adapted to small differences in the thickness of the sheet material without a need of adding or removing any parts from the construction.

The score lines are preferably produced by pressing the sheet material. Pressing does not weaken the material or break a polymer coating needed to provide a liquid and gas barrier. If such properties are not a priority, however, the score lines may also be produced by mechanical or laser cutting.

Useful materials for the tray include fibrous materials such as paper, paperboard and cardboard, preferably provided with an extruded coating of a heat-sealable polymer. Multilayer coatings of different polymers may be provided for optimizing heat-sealing and liquid and gas barrier properties. Suitable coating polymers include polyethylene (PE) and polypropylene (PP) for heat-sealability, and polyethylene terephthalate (PET), ethylene vinyl alcohol copolymer (EVOH) and polyimide (PA) for a barrier. PET is even the polymer of choice for ovenability of a food package. Further suitable materials for the tray include metals such as aluminum, metal-foiled paper or board, and metal/polymer composites. Metal is useful for providing an effective barrier and for ovenability also. A composite of metal (aluminum) and PET layers adds heat-sealability while preserving ovenability due to the high melting temperature of PET.

The thickness of the sheet material used in the invention may be varied without needing to change or modify the moulding tools. For fiber-based materials the weight of the material may be in the range of 50 to 1000 g/m$^2$, preferably 100 to 600 g/m$^2$, and more preferably 170 to 450 g/m$^2$.

The invention is applicable to the production of deep-drawn trays for various purposes. The uses include disposable tablewear, and in particular trays of various depth for food packages, which are closed with a heat-sealed lid. The lid may be of polymer film, polymer-coated paper or board, or metal/polymer composite. The sealing polymer may be selected for easy peelability of the lid as the package is opened.

BRIEF DESCRIPTION OF THE DRAWINGS

The invention is illustrated by way of examples depicted in the drawings, in which.

DETAILED DESCRIPTION

The apparatus shown in the figures forms a packaging tray 1 from a blank of sheet material 2 by a deep-drawing operation. The sheet material may be uncoated board or paper, polymer coated board or paper, metal-foiled board or paper, possibly with an additional coat of polymer, metal, or a composite of metal and polymer.

Figure 5:
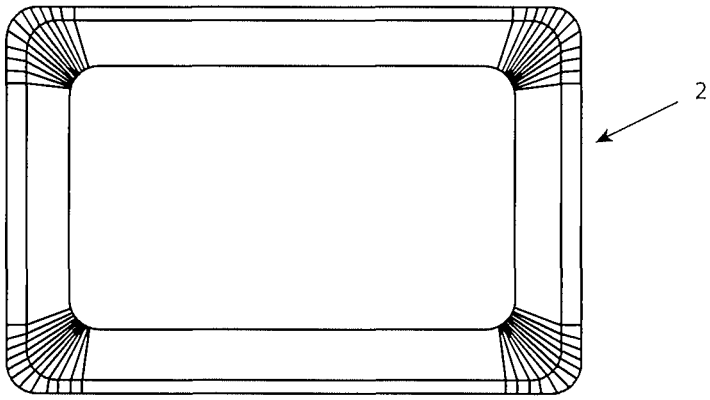
FIGS. 5 and 6 show blanks of sheet material provided with pressed score lines.
Figure 6:
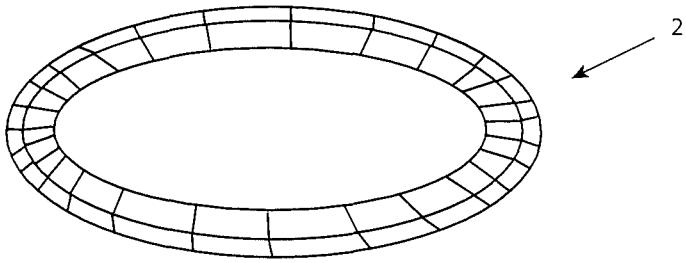
Figure 7:
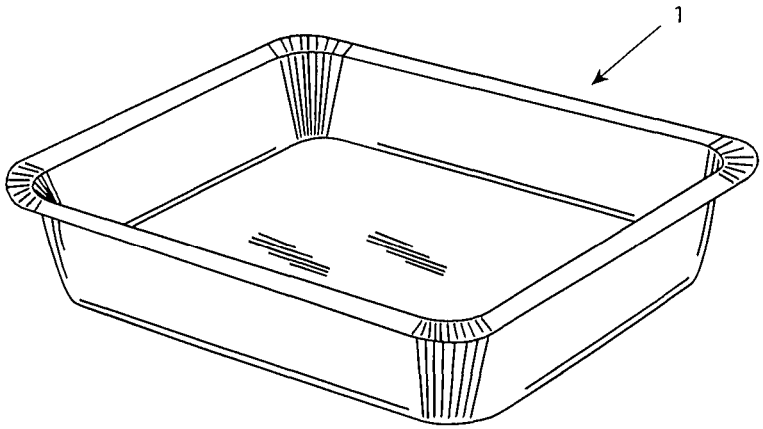
FIG. 7 shows a rectangular tray formed by deep-drawing from the blank of FIG. 5.

Blanks of sheet material 2 are shown in FIGS. 5 and 6. The blank 2 of FIG. 5 is a flat rectangular piece of material, suitable for forming the rectangular tray 1 according to FIG. 7. The blank 2 of FIG. 5 is a flat oval piece of material, suitable for forming an oval tray. The blanks are provided with pressed score lines running transversally to the circumference of the blank. The rectangular blank of FIG. 5 has score lines in the corners only, whereas the oval blank of FIG. 6 has score lines spread over its entire periphery. The pressing operation needed to produce the score lines is known from prior art, and is not described in detail herein.

An alternative way of producing score lines to the blanks of sheet material is mechanical or laser cutting, which is controlled so as to carve the material locally without puncturing it.

Figure 1:
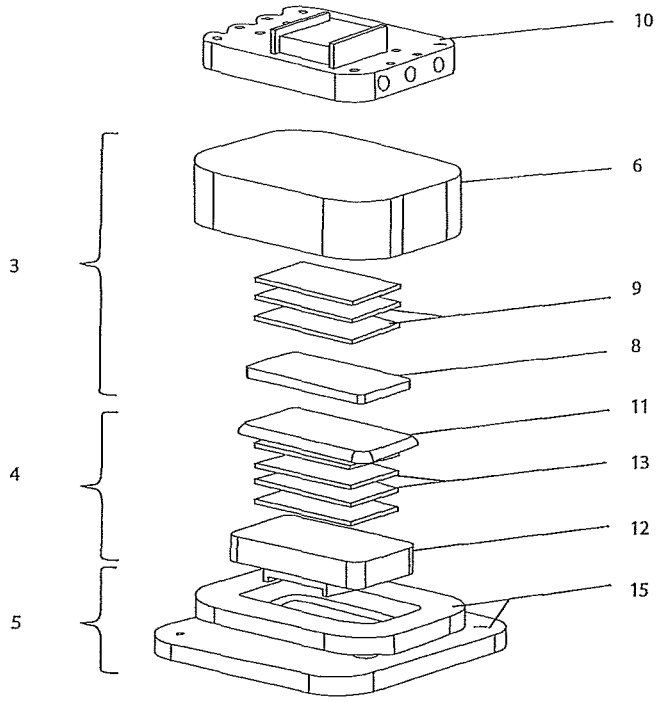
FIG. 1 shows an apparatus according to the invention in an exploded view.
Figure 2:
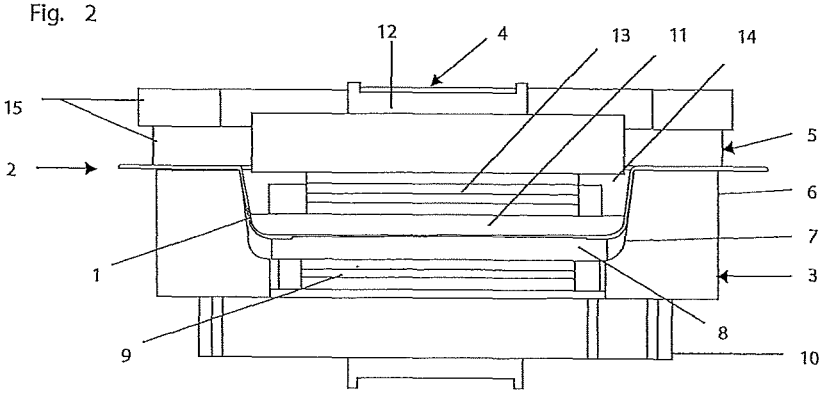
FIG. 2 shows a blank of sheet material drawn to a tray in the apparatus of FIG. 1.

The apparatus as seen in FIGS. 1 and 2 comprises as its main parts a female moulding tool 3 for shaping the tray from its outside, a male moulding tool 4 for shaping the tray from its inside, and clamping means 5 for holding the blank of sheet material during the deep-drawing operation and forming a rim flange to the tray.

The female moulding tool 3 comprises a frame 6 with a cavity 7, which generally corresponds to the shape of the tray 1 being formed. In the embodiment shown in FIGS. 1 and 2 there is a separate bottom plate 8 installed in the cavity 7, which may be raised by means of spacer plates 9 for reducing the depth of the tray being formed. The spacer plates 9 may be removed, however, so that the bottom plate 8 will be level with the bottom of the cavity 7, so that the shape and the depth of the tray 1 are determined by the frame 6 alone.

Below the frame 6 of the female moulding tool 3 there is provided a heating unit 10.

The male moulding tool 4 comprises a plunger plate 11 for forming the bottom of the tray 1 from its inside, a body part 12, which is movable with respect to the female moulding tool 3, which is preferably held stationary during the deep-drawing operation. A number of spacer plates 13 has been positioned between the plunger plate 11 and the body part 12 in order to distance the former from the latter. By vertical movement of the male moulding tool 4 the plunger plate 11 presses the blank 2 of sheet material into the cavity 7 of the female moulding tool 3, to adapt the material to the shape determined by the bottom plate 8 and the side walls of the cavity.

A specific feature of the spacer plates 13 of the male moulding tool 4 is that they are narrower that the horizontal cross-section of the tray 3, so that a free space 14 surrounding the pack of plates 13 is left between the plates and the tray side walls being formed. In this way free forming of the tray side walls is allowed, with controlled wrinkling at the corners of the tray and avoidance of tearing of the sheet material.

The clamping means 5 comprise frames 15, which surround the body part 12 of the male moulding tool 4 and are vertically movable independently of the latter. In the embodiment of FIGS. 1 and 2 the frames 15 form an upper clamping tool, whereas the frame 6 of the female moulding tool 3 serves as a lower clamping tool. The clamping tools 15, 6 have a mutual interface, which holds the rim of the blank 2 in place during the clamping operation and thus forms a flat rim flange to the tray 1 being formed.

The apparatus of FIGS. 1 and 2 is worked by first adjusting the location of the bottom plate 8 of the female moulding tool 3 to correspond to the desired depth of the tray 1 by installing a corresponding number of spacer plates 9 therebelow. Then a pre-scored blank 2 of sheet material is brought between the female and male moulding tools 3, 4, which together with the clamping means 5 stand distanced from each other. The clamping frames 15 are then brought against the frame 6 of the female moulding tool 3 so as to clamp the rim of the blank 2 into place for the deep-drawing operation. Finally the body part 12 of the male moulding tool 4, together with the plunger plate 11 and spacer plates 13, is moved downwards with the plunger plate entering the cavity 7 and pressing the blank 2 against the bottom plate 8 of the female moulding tool 3. The bottom of the tray 3 will conform to the form of the plunger plate 11, while the sides of the tray have room to form freely and achieve evenly formed wrinkling without unseemly compressions and fractures.

Figure 3:
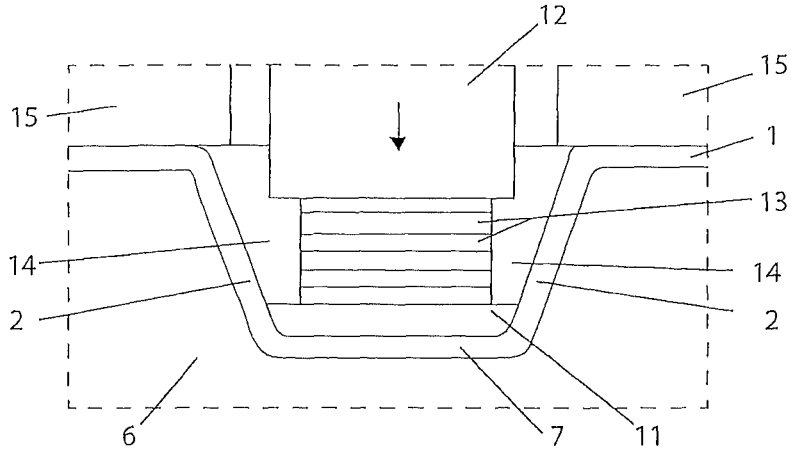
FIG. 3 shows a deep-drawn tray and parts of the apparatus according to another embodiment of the invention.

The embodiment of FIG. 3 is a simplification of that of FIG. 2 in that there are no separate bottom plate and spacer plates in the female moulding tool 3, but the cavity 7 in the latter alone determines the overall shape and depth of the tray 1 that is being formed. The plunger plate 11 and spacer plates 13 of the male moulding tool 4 are similar to those in FIGS. 1 and 2. The same applies to the clamping means 15 as well.

Figure 4:
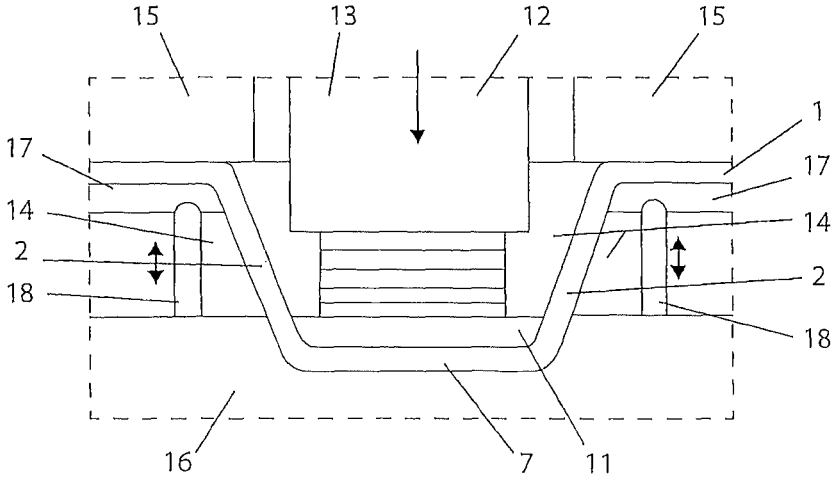
FIG. 4 shows a deep-drawn tray and parts of the apparatus according to a third embodiment of the invention.

The embodiment of FIG. 4 comprises a male moulding tool 4 and upper clamping means similar to those in the previous embodiments of FIGS. 2 and 3. The female moulding tool 3 is different, however. There is a bottom frame part 16, which has a cavity 7 shaped to correspond to the bottom of the tray 1 being formed. A lower clamping frame 17 is connected to the bottom frame part 16 through threaded screws 18, which are used to precisely adjust the distance between the parts 16, 17 and thereby the depth of the finished tray 1. A further significant feature is that there is ample free space on both sides of the tray side walls, thus enhancing the room for free forming of the side walls.

The invention claimed is:

1. A method of deep-drawing a tray from sheet material, comprises the steps of:
   (i) providing the sheet material with score lines transversally to the circumference of the tray being formed,
   (ii) bringing the scored sheet material between a female moulding tool, which comprises a cavity having a cavity bottom for forming the tray bottom outwardly, and a male moulding tool, which comprises a single plunger for forming the tray bottom inwardly,
   (iii) clamping the sheet material along said circumference of the tray by means of the female and male moulding tools, to hold the material during the deep-drawing step,
   (iv) moving the single plunger with respect to the cavity for forming the tray, while, between the cavity bottom and the clamp interface, the male moulding tool is laterally distanced from the sheet material and forms an open space, wherein the score lines determine wrinkling of the sheet material forming a side wall of the tray in the open space formed between the sheet material and the male moulding tool between the cavity bottom and the clamp interface; and,
   (v) recovering the tray from the cavity after being contacted by the single plunger such that the side walls of the tray have been free formed in the open space.

2. The method of claim 1, wherein both the male and the female moulding tools are distanced from the sheet material so as to provide an open space between the cavity bottom and the clamp interface on both sides of the tray side wall being formed.

3. The method of claim 1, wherein the distance between the cavity bottom and the clamp interface is adjusted to correspond to a selected depth of the tray.

4. The method of claim 3, wherein the vertical position of the cavity bottom is adjusted by means of at least one screw connecting the cavity bottom to a clamp on the underside of the tray rim flange.

5. The method of claim 3, wherein the male moulding tool has a plunger plate for forming the tray bottom inwardly, and spacer plates are inserted to adjust the vertical position of the plunger plate.

6. The method of claim 5, wherein said spacer plates are laterally distanced from the sheet material to leave free space inside of the tray side wall being formed.

7. The method of claim 5, wherein the female moulding tool has a cavity bottom plate, the vertical position of which is adjusted by means of spacer plates.

8. The method of claim 1, wherein the sheet material is selected from a group consisting of paper, paperboard, cardboard, polymer-coated paper or board, metal-foiled paper or board, metal, and a composite of metal and polymer.

9. The method of claim 1, wherein the score lines are produced by pressing the sheet material.

* * * * *